US005549766A

United States Patent [19]

Tsutai et al.

[11] Patent Number: 5,549,766

[45] **Date of Patent: *Aug. 27, 1996**

[54] MAGNETIC MATERIAL

[75] Inventors: Akihiko Tsutai; Takahiro Hirai; Shinya Sakurada, all of Kanagawa-ken, Japan

[73] Assignee: Kabushiki Kaisha Toshiba, Kanagawa-ken, Japan

[ * ] Notice: The term of this patent shall not extend beyond the expiration date of Pat. No. 5,482,573.

[21] Appl. No.: 288,808

[22] Filed: Aug. 12, 1994

[30] Foreign Application Priority Data

Aug. 31, 1993 [JP] Japan ..... 5-216281

[51] Int. Cl.[6] ..... H01F 1/055

[52] U.S. Cl. ..... 148/301; 148/315; 420/83; 420/117; 420/125; 252/62.54

[58] Field of Search ..... 148/301, 315; 420/83, 117, 580, 581, 125; 252/62.54

[56] References Cited

FOREIGN PATENT DOCUMENTS

| | | |
|---|---|---|
| 0369097 | 5/1990 | European Pat. Off. . |
| 60-244003 | 12/1985 | Japan . |
| 61-10209 | 1/1986 | Japan . |
| 62-173704 | 7/1987 | Japan . |
| 2-192102 | 2/1990 | Japan . |
| 3-16102 | 1/1991 | Japan . |

OTHER PUBLICATIONS

Fuki et al., "Effect of Zirconeum upon Structure and Magnetic Properties of 2–17 Type Rare–Earth Cobalt Magnets"IEEE Tran on May. MAG 23 Sep. (87) No. 5 pp. 2705–2707.

Patent Abstracts of Japan, vol. 13, No. 293 (C–615) (3641), Jul. 6, 1989 and JP–A–1–87–645 Mar. 31, 1989.

Patent Abstracts of Japan, vol. 13, No. 58 (E–714) (3406) Feb. 9, 1989.

*Primary Examiner*—John Sheehan

*Attorney, Agent, or Firm*—Finnegan, Henderson, Farabow, Garrett & Dunner, L.L.P.

[57] ABSTRACT

A permanent magnet is composed of a magnetic material which is represented by a general formula $R1_xR2_yA_zCo_uFe_{100-x-y-z-u}$ (where R1 is at least one element selected from rare earth elements, R2 is at least one element selected from the group consisting of Sc, Zr and Hf, A is at least one element selected from the group of C, N and P, and x,y,z and u are atomic percent defined as $2 \leqq x$, $4 \leqq x+y \leqq 20$, $0 \leqq z \leqq 20$, $0 \leqq u \leqq 70$), wherein the material includes a principal phase of $TbCu_7$ structure and α-Fe, a peak width at half height of the main peak of X-ray diffraction of the principal phase obtained by using Cu-Kα X-rays with the resolution of 0.02° or less is about 0.8° or less, and a ratio of peak intensity between the principal phase and α-Fe satisfies a relation that the value of $I_{Fe}/(I_p+I_{Fe})$ is about 0.4 or less where $I_p$ is the peak intensity of main peak of X-ray diffraction of the principal phase obtained by using Cu-Kα X-rays and $I_{Fe}$ is that of α-Fe.

12 Claims, 6 Drawing Sheets

MAGNETIC MATERIAL

BACKGROUND OF THE INVENTION

1. Field of the Invention

The present invention relates to a magnetic material.

2. Description of the Related Art

As high performance rare earth permanent magnets, hitherto, a Sm-Co system magnet and a Nd-Fe-B system magnet are known. Their mass production is currently on a sharp increase.

These magnets contain rare earth elements such as Nd and Sm. The rare earth elements bring about a very large magnetic anisotropy derived from the behavior of 4f electrons in a crystal field. As a result, the coercive force (iHc) is increased. Such high performance magnets are mainly used in electric appliances such as loudspeakers, motors, and other devices.

On the other hand, a great demand has arisen recently for down-sized electric appliances and efforts have been made to provide permanent magnets of even higher performance that can be realized by improving the maximum energy product [(BH)max] of a permanent magnet.

The magnetic material including rare earth elements and Fe or Co is promising. For improving (BH)max, an amount of Fe or Co in a principal phase of the material has to increase, because it causes an increase in the saturation magnetic flux density (Bs).

The present inventors and others have discovered a new magnetic material including a principal phase whose crystal structure is $TbCu_7$ type or $ThMn_{12}$ type, which is described in U.S. patent applications of application Ser. No. 961,821 filed on Oct. 16 in 1992, application Ser. No. 858,014 filed on Jul. 6 in 1993 and application Ser. No. 203,371 filed on Mar. 1 in 1994.

The new magnetic material has a high Bs. Therefore, it is considered that a high performance magnet can be made of the material. However it is difficult to make a magnet having a high (BH)max. In general, a heat treating process is needed to obtain a high iHc and in the heat treating process, however, the principal phase of the material, i.e., $TbCu_7$ phase, tends to decompose into α-Fe phase. As a result, the amount of the principal phase is decreased and magnetic properties of the material are deteriorated. Further, the decomposition causes low yield rate of magnets.

SUMMARY OF THE INVENTION

An object of the present invention is to provide a magnetic material having a high saturation magnetic flux density and excellent magnetic anisotropy.

Another object of the present invention is to provide a magnetic material having a high saturation magnetic flux density even after heat treating.

Another object of the present invention is to provide a magnetic material whose principal phase has a $TbCu_7$ crystal structure which can be produced with a high yield rate.

These and other objects of the present invention can be achieved by providing a magnetic material represented by a general formula:

$$R1_xR2_yA_zCo_uFe_{100-x-y-z-u}$$

where R1 is at least one element selected from rare earth elements, R2 is at least one element selected from the group consisting of Sc, Zr and Hf, A is at least one element selected from the group of C, N and P, x,y,z and u are atomic percent defined as $2 \leqq x$, $4 \leqq x+y \leqq 20$, $0 \leqq z \leqq 20$, $0 \leqq u \leqq 70$.

wherein the crystal structure of a principal phase is $TbCu_7$ structure, and a peak width at half height of the main peak of X-ray diffraction of the principal phase using Cu-Kα X-rays with the resolution of 0.02° or less is about 0.8° or less.

The present invention also provides a permanent magnet comprising a magnetic material which is represented by the above general formula, wherein the material comprises a principal phase of $TbCu_7$ structure and α-Fe, a peak width at half height of the main peak of X-ray diffraction of the principal phase obtained by using Cu-Kα X-rays with the resolution of 0.02° or less is about 0.8° or less, and a ratio of peak intensity between the principal phase and α-Fe phase satisfies a relation that the value of $I_{Fe}/(I_p+I_{Fe})$ is about 0.4 or less where $I_p$ is the peak intensity of the main peak of X-ray diffraction of the principal phase obtained by using Cu-Kα X-rays and $I_{Fe}$ is that of α-Fe.

The present invention further provides a magnetic material produced by a method comprising the steps of:

melting a raw material represented by the above general formula:

quenching the melted raw material to provide a material comprising a principal phase of $TbCu_7$ structure; and heat treating the quenched material at a temperature selected to provide a peak width of about 0.8° or less at half height of the main peak of X-ray diffraction of the principal phase obtained by using Cu-Kα X-rays with a resolution of 0.02° or less, and to provide a value of $I_{Fe}/(I_p+I_{Fe})$ to be about 0.4 or less where $I_p$ is the peak intensity of the main peak of X-ray diffraction of the principal phase obtained by using Cu-Kα X-rays and $I_{Fe}$ is that of α-Fe.

The present invention further provides a method of producing a magnetic material, comprising the steps of:

melting a raw material represented by the above general formula:

quenching the melted raw material to provide a material comprising a principal phase of $TbCu_7$ structure; and heat treating the quenched material at a temperature selected to provide a peak width of about 0.8° or less at half height of the main peak of X-ray diffraction of the principal phase obtained by using Cu-Kα X-rays with a resolution of 0.02° or less, and to provide a value of $I_{Fe}/(I_p+I_{Fe})$ to be about 0.4 or less where $I_p$ is the peak intensity of the main peak of X-ray diffraction of the principal phase obtained by using Cu-Kα X-rays and $I_{Fe}$ is that of α-Fe.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
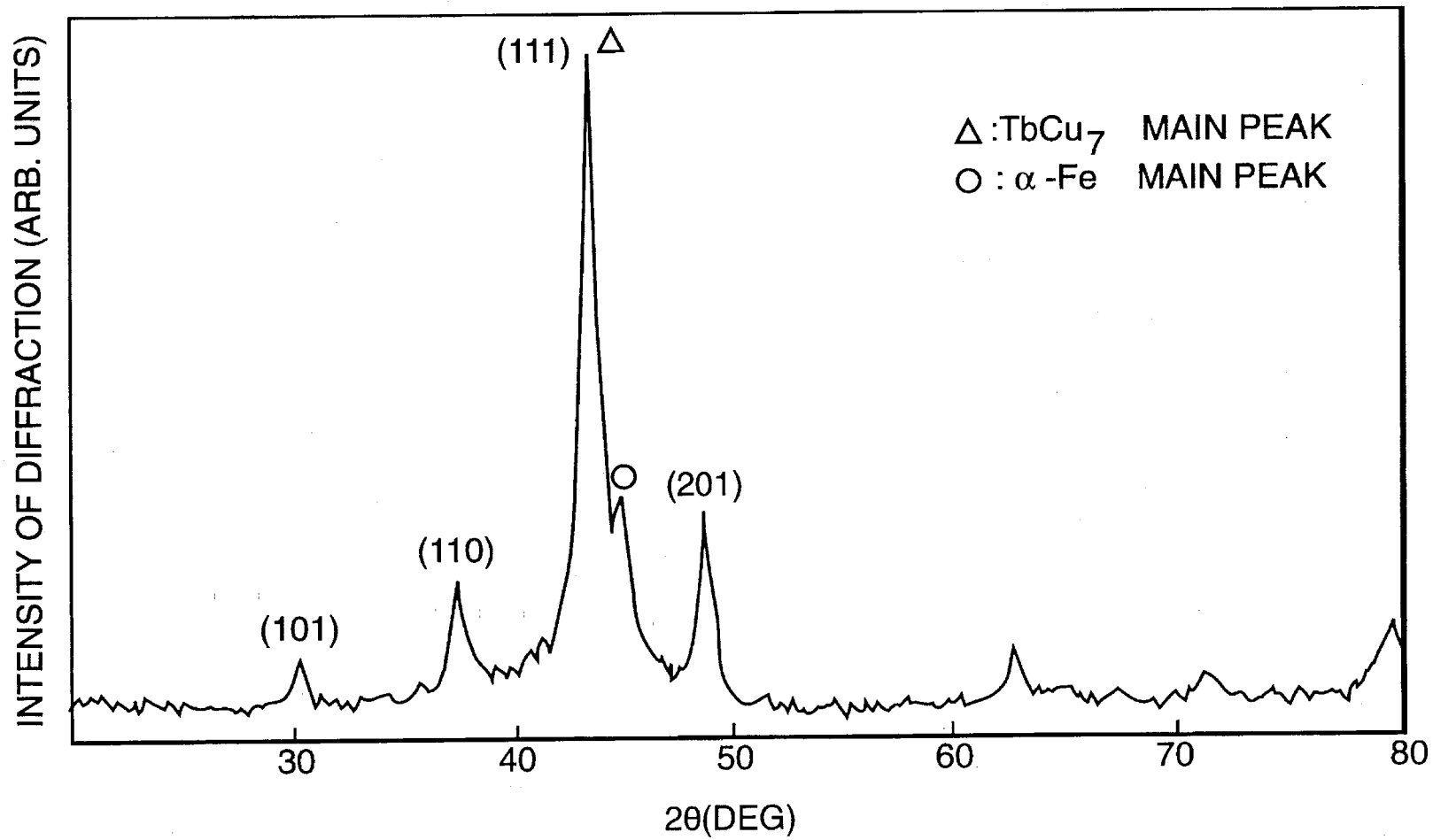
FIG. 1 is a graph showing an X-ray diffraction pattern of a magnetic material of Example 1 of the present invention.

The inventors of the present invention discovered the above-mentioned decomposition of the $TbCu_7$ phase to α-Fe and researched the decomposition. As a result, it was found that a peak width at half height of the main peak of X-ray diffraction of the $TbCu_7$ phase relates to the decomposition closely. When the peak width with the resolution of 0.02° or less is about 0.8° or less, a heat treatment of high temperature does not bring about the decomposition.

A composite ratio of a magnetic material of the present invention is represented by a general formula:

$$R1_xR2_yA_zCo_uFe_{100-x-y-z-u}$$

where R1 is at least one element selected from rare earth elements, R2 is at least one element selected from the group consisting of Sc, Zr and Hf, A is at least one element selected from the group of C, N and P, x,y,z and u are atomic percent defined as $2 \leqq x$, $4 \leqq x+y \leqq 20$, $0 \leqq z \leqq 20$, $0 \leqq u \leqq 70$.

Further, the crystal structure of a principal phase is $TbCu_7$ structure. A characteristic point is that a peak width at half height of the main peak of X-ray diffraction of the principal phase using Cu-Kα X-rays with the resolution of 0.02° or less is about 0.8° or less.

The role that each of the component elements plays in the magnetic material expressed by the formula and the basis for defining the composite ratio of the component elements will be described.

The element R1 is at least one element selected from rare earth elements, such as La, Ce, Pr, Nd, Sm, Eu, Gd, Tb, Dy, Ho, Er, Tm, Yb, Lu, Y or a combination of any of these elements. The element R1 serves to significantly improve the magnetic anisotropy of the magnetic material and provide it with a large coercive force. If the content of the element R1 is too little, α-Fe is formed to a great extent and no large coercive force can be obtained. Therefore, the content of the element R1 is preferably about 2 atomic percent or more. On the other hand, if the element R1 is distributed to excess amount, the saturation magnetic flux density is undesirably lowered. Therefore, the content of the element R1 is preferably about 16 atomic percent or less. It is particularly preferable that the sum of Nd, Pr, Sm, Er, Dy and Tb occupies more than about 50 percent of the element R1 to further improve the magnetic anisotropy of the magnetic material.

The element R2 is at least one element selected from the group consisting of Sc, Zr and Hf. The element R2 can increase the concentration of Fe and Co in the principal phase by occupying part of the rare earth element site of the phase to reduce the average atomic radius of the rare earth element site. It also can accelerate the formation of the principal phase typically having a $TbCu_7$ crystal structure. The element R2 is not necessarily required. However for accelerating the formation of the principal phase, the content of the element R2 is preferably about 0.01 atomic percent or more. On the other hand, if the element R2 is distributed to excess, the saturation magnetic flux density is reduced. Therefore, the content of the element R2 is preferably about 18 atomic percent or less. More preferably the content of the element of R2 is in the range of about 0.5 to about 6 atomic percent. When Co is free, i.e., u=0, the element R2 is important, because the element R2 can block production of α-Fe so as to increase the coercive force.

By defining the total amount of the elements R1 and R2 to be within a range of about 4 to about 20 atomic percent, it is possible to obtain a magnetic material possessing both excellent anisotropy and high coercive force. More preferably the sum of the element R1 and R2 is within a range of about 6 to about 16 atomic percent.

The element A is at least one element selected from the group of C, N and P. The element A is principally located at the interstitial positions of the crystal structure of the principal phase, i.e., $TbCu_7$ crystal structure, extending the crystal lattice as compared with the case where the element A is not contained and varying the energy band structure of electrons. As a result, the Curie temperature, saturation magnetic flux density and magnetic anisotropy of the principal phase are improved. The element A is not necessarily required. However for obtaining the above-mentioned effect, the content of the element A is preferably about 0.01 atomic percent or more. On the other hand, if the element A is distributed to excess, it is difficult to form the principal phase. Therefore, the content of the element A is preferably about 20 atomic percent or less. More preferably the content of the element A is about 10 atomic percent or less. A part of the element A is possibly replaced by H.

The element Co(cobalt) serves to increase a content of Co and Fe in the principal phase so as to improve the saturation magnetic flux density of the magnetic material. Also the presence of Co can improve the stability of the principal phase. The cobalt is not necessarily needed. However for obtaining the above-mentioned effect, the content of Co is preferably about 4 atomic percent or more. More preferably it is about 10 atomic percent or more. On the other hand, if Co is distributed to excess amount, the saturation magnetic flux density is lowered. The content of Co is preferably about 70 atomic percent or less. More preferably it is about 50 atomic percent or less.

The element Fe(iron) is a principal element of the composition. The iron contributes to an increase of the saturation magnetic flux density of the composition. The content of Fe is preferably the largest of the elements composing the material, and is preferably about 50 atomic percent or more of the total amount of Fe and Co. More preferably it is about 70 atomic percent or more.

An element M which is at least one element selected from the group consisting of Si, Ti, Cr, V, Mo, W, Mn, Ni, Ga and Al may partly replace the elements Fe so that the ratio of the principal phase, i.e., $TbCu_7$ phase, to the whole magnetic compound may be increased. Moreover, the concentration of the element of Fe in the principal phase can be raised by such partial replacement. However the excess of the element M causes a reduction of the saturation magnetic flux density. Therefore the amount of the replacement is preferably about 20 atomic percent of the content of Fe or less. The effect of the element M may appear from about 0.01 atomic percent.

The combined concentration of Fe and Co is preferably about 90 atomic percent or more in the principal phase exclusive of the element A to obtain high saturation magnetic flux density. For obtaining that concentration, the total amount of the element R2 and Co is preferably about 0.01 atomic percent or more. When the element M partially replaces Fe, the concentration of Fe, Co and the element M is preferably about 90 atomic percent or more, however the concentration of Fe and Co is more preferably about 90 atomic percent or more. Since Fe is effective in high saturation magnetic flux density, the amount of Fe in the principal phase is preferably the largest among the elements composing the principal phase.

The magnetic material of the present invention is mainly composed of the principal phase whose crystal structure is $TbCu_7$ crystal structure and the volume of the principal phase is the largest in the material. Further the magnetic material of the present invention may comprise other phases such as α-Fe, oxides or impurities. The principal phase dominates the saturation magnetic flux density. Therefore, the volume of the principal phase is preferably larger than about 50 volume percent.

The lattice constants a and c of a hexagonal crystal are related to the concentration of Fe and Co in the principal phase. Especially, the ratio of c/a is closely related to the concentration of Fe and Co in the $TbCu_7$ crystal. As the ratio of c/a increases, the concentration becomes larger. In the $TbCu_7$ crystal, when the value of c/a is more than about 0.85, the content of Fe and Co in the principal phase having the $TbCu_7$ crystal structure may become about 90 atomic percent or more.

In the present invention, a peak width at half height of the main peak of X-ray diffraction of the principal phase using Cu-Kα X-rays is about 0.8° or less with an angle resolution of 0.02° or less. This is important to avoid decomposition of the principal phase after a heat treatment. As a result of research of the inventors, it is considered that mechanical strain in the principal phase may cause the decomposition. The amount of the strain relates the peak width at half height of X-ray diffraction of the principal phase.

The present inventors found that when the peak width is about 0.8° or less using Cu-Kα X-rays with a resolution angle of 0.02°, the principal phase having $TbCu_7$ crystal structure in the magnetic material is hard to decompose even after a heat treatment. Therefore the decomposition probability of the principal phase can be reduced. As a result, the amount of α-Fe in the magnetic material can be reduced and a yield rate becomes high.

Accordingly, a permanent magnet effectively using the performance of the magnetic material can be made of the magnetic material represented by a general formula:

$$R1_xR2_yA_zCo_uFe_{100-x-y-z-u}$$

where R1 is at least one element selected from rare earth elements, R2 is at least one element selected from the group consisting of Sc, Zr and Hf, A is at least one element selected from the group of C, N and P, x,y,z and u are atomic percent defined as $2 \leqq x$, $4 \leqq x+y \leqq 20$, $0 \leqq z \leqq 20$, $0 \leqq u \leqq 70$, wherein the crystal structure of a principal phase is $TbCu_7$ structure, and a peak width at half height of main peak of X-ray diffraction of the principal phase using Cu-Kα X-rays is about 0.8° or less with high yield rate. In other words, the magnetic material can be good raw material for a permanent magnet.

A magnetic material of the present invention can be manufactured by, for example, the process as described below.

In the first step, a mixture consisting of predetermined amounts of the element R1, R2, A, Co, Fe and M, if necessary, is melted by an arc or high frequency heating to prepare a molten alloy. Then, the resultant melt is sprayed onto a single or twin roll rotating at high speed so as to rapidly quench the melt. The rapid quenching process which can be employed in the present invention also includes, for example, a rotary disc method in which the melt is sprayed onto a rotating disc for the rapid quenching of the melt, and a gas atomizing method in which the melt is sprayed into an inert gas such as He for the rapid quench of the melt. It is desirable for the rapid quenching process to be carried out under an inert gas atmosphere such as Ar or He, or under vacuum in order to prevent the magnetic properties of the resultant magnetic material from being deteriorated by oxidation accompanying the rapid quenching process.

It is also possible to employ a mechanical alloying method or a mechanical grinding method, in which a mechanical energy is imparted to the mixture of the starting materials noted above for alloying the mixture. In each of these methods, the mixture is subjected to a solid phase reaction for the alloying. For carrying out the solid phase reaction, the mixture is put in, for example, a planetary ball mill, a rotary ball mill, an attritor, a vibrating ball mill, or a screw type ball mill, so as to give a mechanical impact to the mixture.

Further, the magnetic material can also be manufactured by casting the molten material prepared by the arc or high frequency heating.

A powdery magnetic material is obtained by pulverizing the alloy prepared by the methods described above in, for example, a ball mill, a brown mill or a stamp mill. Incidentally, the alloy prepared by the mechanical alloying method or the mechanical grinding method is already powdery and, thus, the pulverizing step can be omitted in this case.

The powdery magnetic material generally has some amount of strain. Therefore, the peak width at half height of the main peak of X-ray diffraction of the principal phase using Cu-Kα X-rays is generally more than 0.8°. For reducing the peak width, it is effective to apply heat treating to the material, for example, at about 550° C. or below for 1 minute or long. If the temperature is too high, the amount of α-Fe increases. The low temperature heat treating can reduce the peak width at half height without increasing the amount of α-Fe in the magnetic material.

However, for example, when using the rapid quenching method, by controlling the quenching speed the amount of strain can be reduced. If the peak width at half height is less than 0.8° as quenched, the heat treating can be omitted.

A method for producing a permanent magnet from the magnetic material produced by the above-described methods will now be described.

The powdery magnetic material is hot-pressed or hot-isostatic pressed (HIP) to obtain a molded body having a high density which is used as a permanent magnet. A magnetic field may be applied to the body in the pressing step to align the crystal orientations of the permanent magnet.

A permanent magnet may be obtained by sintering the powdery magnetic material.

A permanent magnet may be obtained by mixing the powdery magnetic material with resin, such as epoxy resin or nylon system resin, thereafter molding the resultant mixture to form a bond magnet. In the case where a thermosetting resin of an epoxy resin is used as the resin, a cure treatment at 100° to 200° C. is preferably performed after compression molding. In the case where a thermoplastic resin of a nylon resin is used as the resin, it is preferable to use an injection molding method.

A permanent magnet may be obtained by mixing the powdery magnetic material with metal or alloy having a low melting point, preferably lower than that of the powdery material, and thereafter molding the resultant mixture to form a metal bond magnet. As the metal, it is possible to use Al, Pb, Sn, Zn, Mg or the like, and as the alloy, it is possible to use the alloy composed of these metal elements.

In the case where the half-width of the main peak of $TbCu_7$ phase exceeds 0.8°, it is preferable to reduce the value of the half-width by using some treatment, such as the above-mentioned heat treatment below 550° C.

In the manufacturing process of the powdery magnetic material or the magnet, a heat treatment is effected for 0.1 to 100 hours at a temperature of 300° to 1000° C. in inert gas such as Ar, He, or vacuum to thereby considerably improve the coercive force.

An example of a method for producing a magnetic material which contains N (nitrogen) as the element A as defined in the general formula, is described next.

A heat treatment is applied to the magnetic material powder in a nitrogen gas atmosphere kept at 0.001 to 100 atoms for 0.1 to 100 hours at a temperature of 300° to 800° C. For the atmosphere of the treatment, it is possible to use nitrogen compound gas such as ammonia or the like instead of the nitrogen gas. It is possible to effect the nitriding treatment before the heat treatment for improving the coercive force. Also, a gas which does not contain nitrogen may be added to the nitrogen gas or the nitrogen compound gas for carrying out the nitriding treatment. In the case of adding an oxygen-containing gas, however, it is desirable to set the partial pressure of the oxygen gas at a level not exceeding 0.02 atm. so as to avoid formation of oxides during the heat treatment, said oxide formation leading to deterioration in the magnetic properties of the resultant magnetic material.

It is also possible to use as the starting material a nitrogen compound such as R1N (R1: rare earth elements), in the process of preparing the powdery magnetic material. In this case, the starting material is subjected to a solid phase reaction described previously so as to enable the resultant material to contain nitrogen as the element A which is included in the general formula.

As mentioned above, a heat treatment is effected for 0.1 to 100 hours at a temperature of 300° to 1000° C. in inert gas such as Ar, He, or vacuum to thereby considerably improve the coercive force. However, after nitriding-process, the treatment can be dispensed.

FIG. 1 shows a typical X-ray diffraction pattern of a magnetic material of the present invention having a $TbCu_7$ phase as the principal phase obtained by using Cu-Kα radiation with an angle resolution of 0.02°.

As seen from FIG. 1, the diffraction angle 2θ has peak levels that appear somewhere around 30°, 37°, 42°, 45° and 48° between 20° and 55°. The peak appearing around 45° may be attributable to the diffraction of X-rays by α-Fein the magnetic material. All the remaining peaks are indexed in terms of $TbCu_7$ crystal structure. The indices (h, k, l) where h, k, l are the integers in FIG. 1 represent the $TbCu_7$ type structure with indices. In FIG. 1, the main peak of the principal phase appears around 42° and the main peak of the α-Fe appears around 45°.

As above mentioned, the peak width at half height of the main peak of X-ray diffraction of the principal phase using Cu-Kα X-rays is about 0.8° or less and it can be obtained by low temperature heat treatment such as below 550° C. However the peak width at half height can be obtained by high temperature heat treatment such as above 550° C., but in such a case, the amount of α-Fe is very large. Therefore the low temperature heat treatment is effective to reduce the peak width at half height without increasing the amount of α-Fe or α-(Fe,Co).

The amount of α-Fe is preferably small. Therefore, a ratio of peak intensity between the principal phase and α-Fe preferably satisfies a relation that the value of $I_{Fe}/(I_p+I_{Fe})$ is about 0.4 or less where $I_p$ is the peak intensity of the main peak of X-ray diffraction of the principal phase obtained by using Cu-Kα X-rays with an angle resolution of 0.02° and $I_{Fe}$ is that of α-Fe. The low temperature heat treatment can produce the magnetic material which satisfies the peak width at half height of 0.8° or less and $I_{Fe}/(I_{m.p.}+I_{Fe})\leqq 0.4$ simultaneously. If the material comprises Co, α-Fe produced by decomposition of the principal phase may include Co (the solid solution of α-(Fe,Co)) or the element M. In the present invention, α-Fe means a phase comprising α-Fe or such a solid solution, also.

Examples of the present invention will now be described.

EXAMPLE 1

First of all, high purity raw materials of Sm, Zr, Co and Fe are adjusted to Sm 8.0 at %, Zr 1.2 at %, Co 27.0 at % and the remainder or balance substantially made of Fe. They are melted in an Ar gas atmosphere. Thereafter, the molten metal is introduced into casting molds to form an ingot. Subsequently, the ingot is melted, and is rapidly cooled and made into thin strips by a liquid rapid cooling method which includes injecting the molten material onto a copper roll having a diameter of 300 mm and rotating at a rotational speed of 40 m/sec in an Ar gas atmosphere. The X-ray diffraction pattern of the resultant strips with a CuKα ray is shown in FIG 1.

In the diffraction pattern of FIG. 1, the indices are designated for the elements in the $TbCu_7$ crystal structure except for α-(Co,Fe) to obtain the lattice constant ratio (c/a) of the phase. As a result, the value of (c/a) is 0.8726. From this value, it is predicted that the total amount of Fe and Co of the $TbCu_7$ phase is 91.8 at %. Actually, the total amount of Fe and Co of the $TbCu_7$ phase measured through a TEM analysis is 91.6 at %.

Also, from the diffraction pattern shown in FIG. 1, the peak width at half height of the main diffractive intensity of the $TbCu_7$ is 0.83°.

Figure 2:
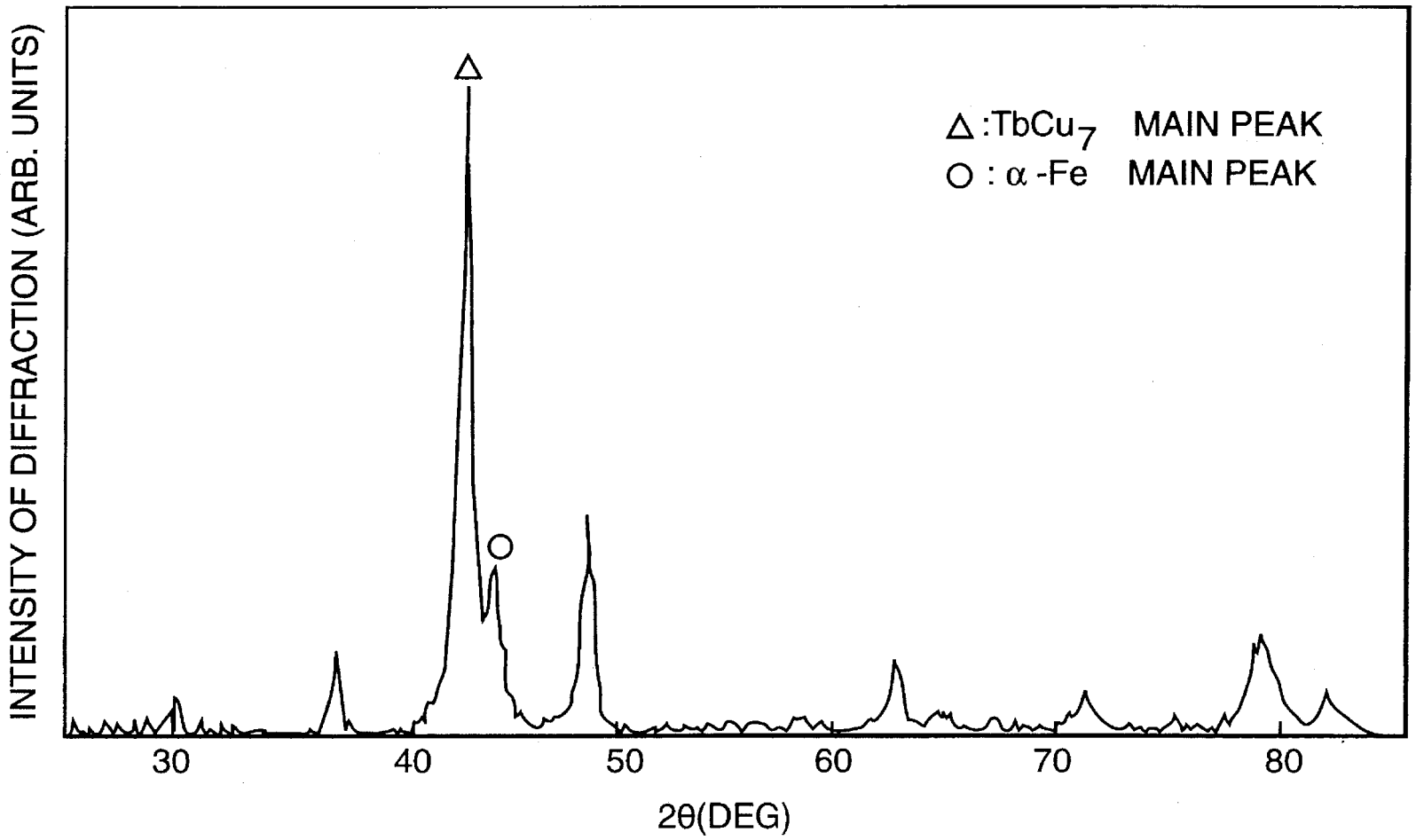
FIG. 2 is a graph showing an X-ray diffraction pattern of a magnetic material of Example 1 of the present invention.

Subsequently, the rapidly quenched strips are subjected to the heat treatment for one hour at 400° C. The diffraction pattern of the resultant strips with a CuKα ray is shown in FIG. 2. The value of (c/a) determined from the diffraction pattern is 0.8739.

An intensity ratio between the α-Fe peak indicated by ○ in FIG. 2 and the main peak indicated by Δ in FIG. 2 of the $TbCu_7$ phase is not largely changed in comparison with the sample before the heat treatment (FIG. 1).

From the diffraction pattern of FIG. 2, it is understood that the peak width at half height of the main peak of the $TbCu_7$ phase is 0.61° and is decreased in comparison with the sample before the heat treatment. This reflects the moderation of the strains in the rapidly quenched strips through the heat treatment.

Subsequently, the heat treated sample is further subjected to the heat treatment for 15 minutes at 700° C. in vacuum and is pulverized to obtain the magnetic material powder having an average particle diameter of 20 μm.

Subsequently, a nitriding treatment is applied to the powdery material under a nitrogen atmosphere of 20 atm for 6 hours at 400° C. so as to obtain a powdery magnetic material containing some amount of N. The resultant powdery magnetic material is found to consist of Sm 7.4 at %. Zr 1.1 at %, Co 25.0 at %, N 8.0 at % and the balance of Fe, substantially.

Subsequently, epoxy resin is added to the magnetic material powder by 2 wt % and mixed therewith. The mixture is compression molded and followed by applying a curing treatment to the molded material for 2.5 hours at a temperature of 150° C. so as to obtain a bond magnet.

The magnetic properties of the obtained bond magnet are the residual magnetic flux density of 6.8 kG and the magnetic coercive force of 9.8 kOe.

Figure 3:
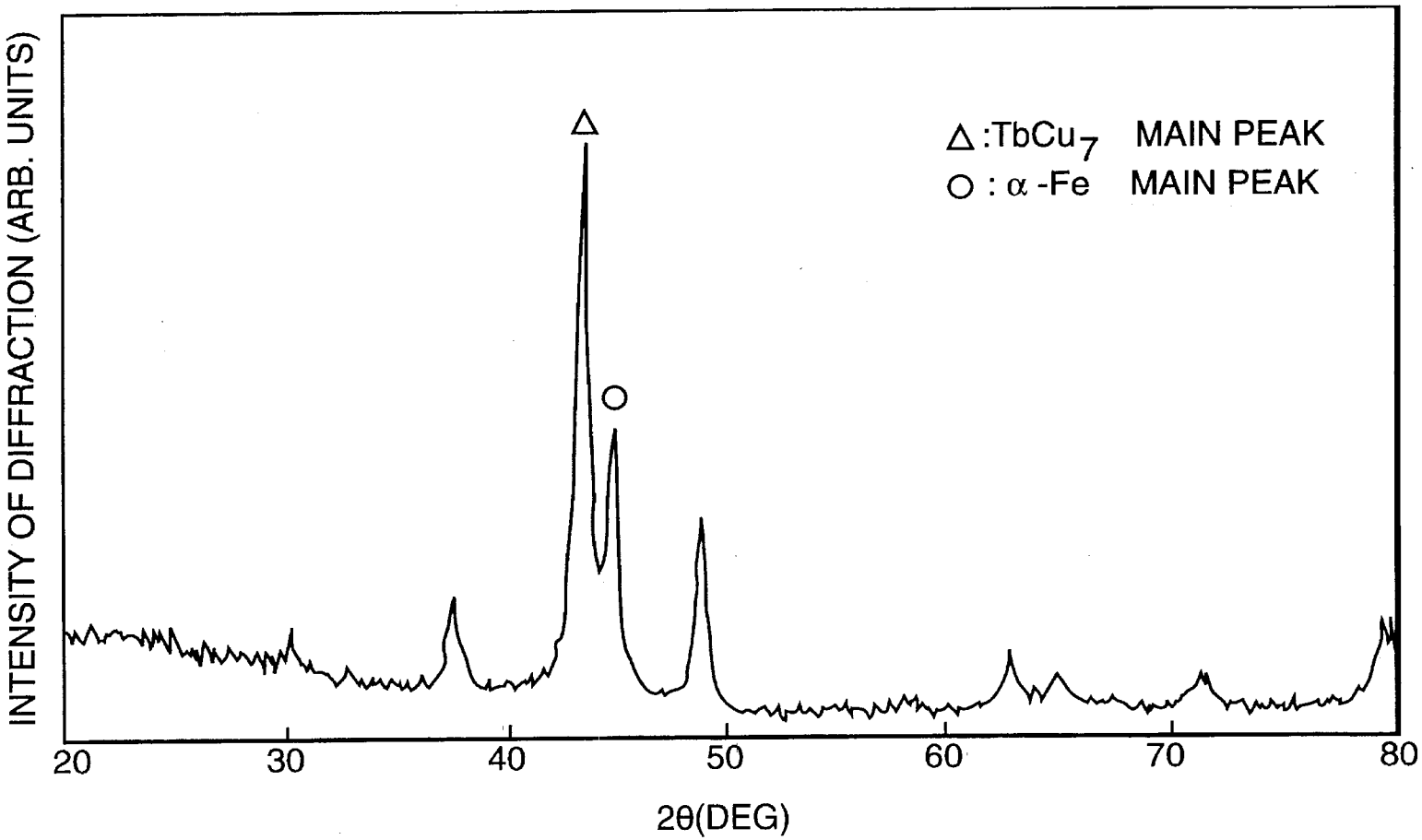
FIG. 3 is a graph showing an X-ray diffraction pattern of a magnetic material of Example 1 of the present invention.

Also, the X-ray diffraction pattern of the sample after nitriding is shown in FIG. 3. In comparison with the diffraction patterns shown in FIGS. 1 and 2, the peak of α-Fe is increased but an intensity ratio between the α-Fe peak indicated by ○ in FIG. 3 and the main peak indicated Δ in FIG. 3 of the $TbCu_7$ phase is 35:65, i.e., the value of $I_{Fe}/(I_{Fe}+I_p)$ is 0.35.

From the diffraction pattern, it is found that there is substantially no other phase in the magnetic material. The amount of the principal phase is more than 60 vol %.

The rapidly quenched thin strips produced in accordance with Example 1 are heated for 15 minutes at 700° C. to obtain a sample as Comparative example 1. The sample is analyzed by the X-ray diffraction method in the same way as in Example 1. The X-ray diffraction pattern is shown in FIG. 4.

Figure 4:
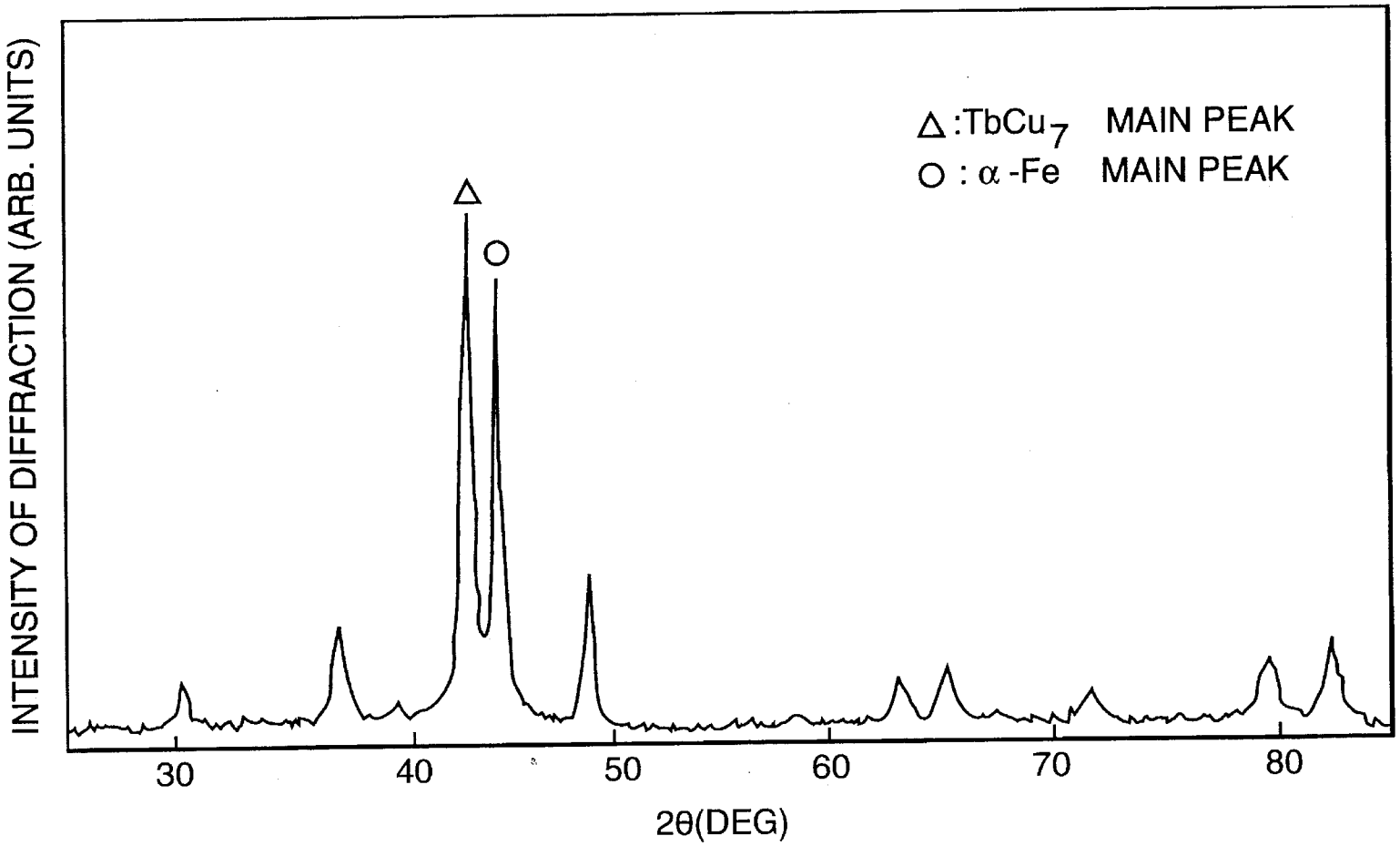
FIG. 4 is a graph showing an X-ray diffraction pattern of a magnetic material of Comparison example 1.

By the comparison between the X-ray diffraction patterns in FIG. 4 and FIG. 3, the α-Fe precipitation in the sample of the comparison example 1 is large, i.e., a large decomposition has occurred in comparison with the sample of Example 1. In FIG. 4, an intensity ratio between the α-Fe peak indicated by ○ in FIG. 4 and the main peak indicated by Δ in FIG. 4 of the $TbCu_7$ phase is 47:53, i.e., the value of $I_{Fe}/(I_{Fe}+I_p)$ is 0.47.

Since the step of the heat treatment at 400° C. to be carried out before the heat treatment at 700° C. is omitted in Comparison example 1, the precipitation of α-Fe which is a decomposition of the $TbCu_7$ phase is increased in comparison with the sample having the diffraction pattern shown in FIG. 3. Namely, since the rapidly quenched strip having a large peak width of the main peak of the $TbCu_7$ phase is heated at 700° C. without any treatment for reducing the half-width, the large decomposition of the $TbCu_7$ phase is caused.

A bond magnet made of the strip in Comparison Example 1 by the same method in Example 1 has a residual magnetic flux density of 3.5 kG and a coercive force is 2.7 kOe.

EXAMPLES 2 TO 7

High purity Nd, Pr, Sm, Co, Fe, Zr, Hf, Mo and Cr are adjusted in a preselected manner, and six kinds of rapidly quenched thin strips are produced in the same method as in Example 1 except for nitriding. The composition analysis, powder X-ray diffraction, and TEM analysis are conducted for each strip.

As a result, the strips have the compositions shown in Table 1, and have the same X-ray diffraction pattern as that described in conjunction with FIG. 1.

The total amount of T* in the main phase is those shown in Table 1 where T* is Fe, Co and M element which replaces a part of Fe.

The peak width of the main peak of the $TbCu_7$ phase of each rapidly quenched thin strip and the peak width after the heat treatment for one hour at 400° C. obtained by the X-ray diffraction are shown in Table 1. In all examples, after the heat treatment at 400° C., the existence of α-Fe is found, however the intensity ratio of X-rays diffraction, $I_{Fe}/(I_{Fe}+I_p)$, is less than 0.4 and the magnetic material is substantially composed of the principal phase and α-Fe.

Subsequently, each rapidly quenched thin strip is subjected to the heat treatment for 15 minutes at 700° C. The amount of α-Fe increases slightly, however the value of $I_{Fe}/(I_{Fe}+I_p)$ does not become more than 0.4. Thereafter the strips are pulverized to produce magnetic material powder having an average particle diameter of 60 μm. Subsequently, epoxy resin is added to the magnetic material powder by 2 wt % and mixed therewith. The mixture is compression molded and followed by a curing treatment for 2.5 hours at a temperature of 150° C. to obtain a bond magnet. Each obtained bond magnet is inspected with respect to the residual magnetic flux density (Br) and magnetic coercive force (iHc) at room temperature. The result is shown in Table 1.

TABLE 1

| Example No. | Composition (at %) ("bal": balance) |
|---|---|
| 2 | $Sm_{8.0}Nd_{0.2}C_{6.2}P_{0.2}Fe_{bal}$ |
| 3 | $Sm_{8.1}Nd_{0.6}Zr_{1.2}Cr_{4.0}Co_{25.0}Fe_{bal}$ |
| 4 | $Sm_{8.4}Ce_{0.3}Zr_{0.6}Hf_{0.6}Mo_{4.1}W_{0.1}Co_{27.1}Fe_{bal}$ |
| 5 | $Sm_{7.1}Pr_{0.5}Zr_{2.5}Ti_{4.3}Ni_{0.1}Co_{23.1}Fe_{bal}$ |
| 6 | $Sm_{7.4}Er_{0.7}Zr_{2.1}Sc_{0.1}V_{5.3}Mn_{0.1}Co_{21.6}Fe_{bal}$ |
| 7 | $Sm_{6.9}Zr_{3.2}Si_{4.6}Al_{0.1}Ga_{0.2}Co_{24.3}Fe_{bal}$ |

| Example No. | T* (at %) | Br (kG) | iHc (kOe) | peak width A | peak width B |
|---|---|---|---|---|---|
| 2 | 91.2 | 5.8 | 6.0 | 0.86 | 0.61 |
| 3 | 90.9 | 5.4 | 4.8 | 0.82 | 0.58 |
| 4 | 91.2 | 5.6 | 4.7 | 0.84 | 0.59 |
| 5 | 91.6 | 5.7 | 4.9 | 0.88 | 0.63 |
| 6 | 91.3 | 5.3 | 4.3 | 0.85 | 0.56 |
| 7 | 91.5 | 5.4 | 4.8 | 0.90 | 0.57 |

"peak width A" is a value as quenched.
"peak width B" is a value after the heat treatment at 400° C.

A comparison example 2 is made of the same composition as those of Examples 2 to 6 without the heat treatment for one hour at 400 ° C. Each value of $I_{Fe}/(I_{Fe}+I_p)$ of Comparison example 2 is more than 0.4 and each residual magnetic flux density is 4 kG or less and each magnetic coercive force is 3 kOe or less. Therefore, the magnets of the comparison example 2 are much inferior to the bond magnets in accordance with Examples 2 to 7 in Table 1.

Also, from Table 1, it is understood that by affecting the heat treatment for one hour at 400° C. to the rapidly quenched strips, the peak width of the main peak of the $TbCu_7$ phase can be 0.8° or less.

EXAMPLE 8

Except that a copper roll having a circumferential speed of 30 m/s is used as a rapid quenching method, the rapidly quenched thin strip having the same composition as that of Example 1 is produced in the same way.

Figure 5:
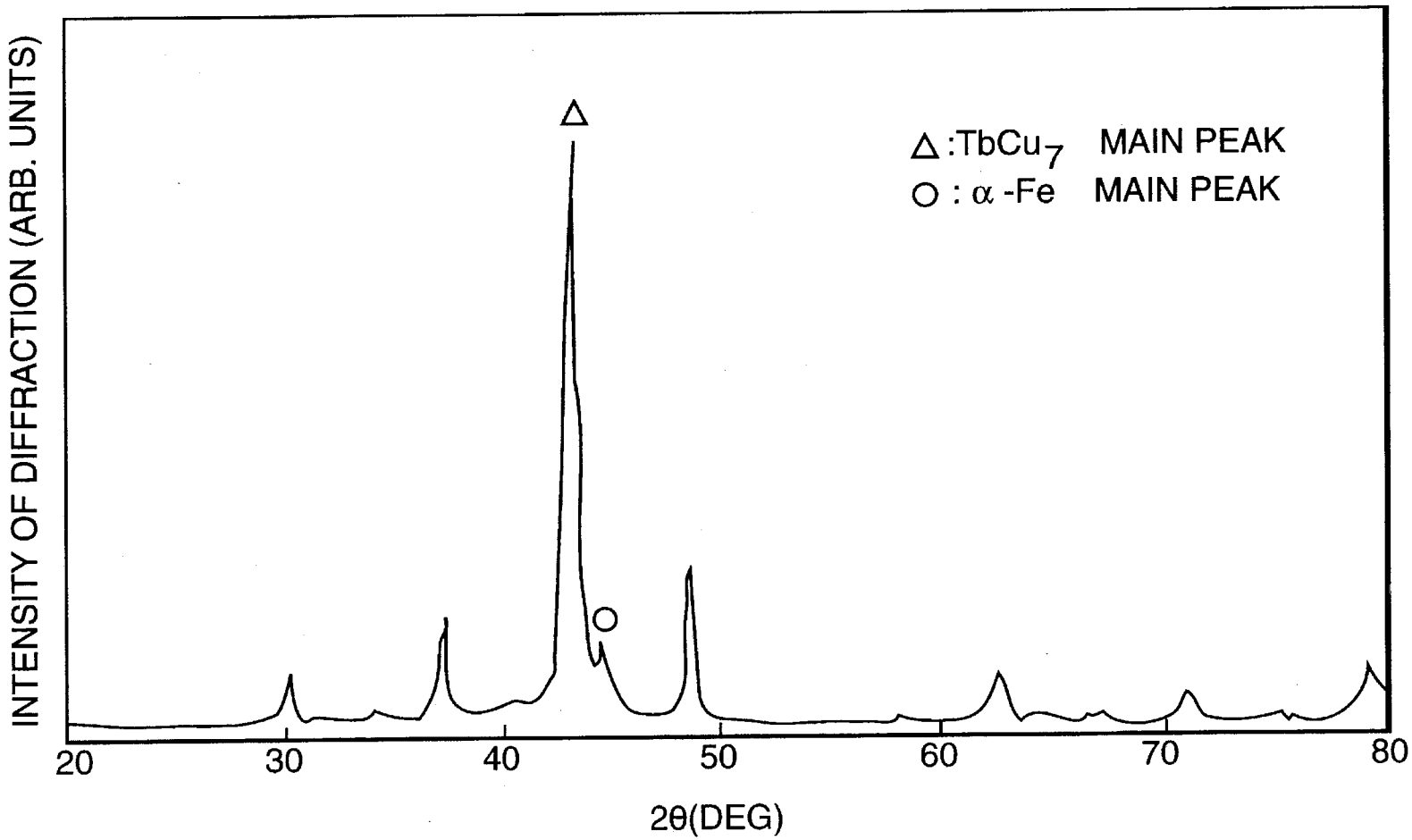
FIG. 5 is a graph showing an X-ray diffraction pattern of a magnetic material of Example 8 of the present invention.

FIG. 5 shows the diffraction pattern of the resultant thin strip by using a CuKα ray. In the diffraction pattern, the indices designate the elements in the $TbCu_7$ crystal structure except for α-(Fe,Co). The value of (c/a) is 0.8697, from which it is predicted that the total amount of Fe and Co of the $TbCu_7$ phase is 91.6 at %. Actually, the total amount of Fe and Co of the $TbCu_7$ phase is 91.5 at % by a TEM analysis.

Further, the peak width of the main diffractive intensity of the $TbCu_7$ phase is 0.52°. This value is small enough in comparison with Example 1 (0.83°) in which a circumferential speed of 40 m/s was used. Namely, it is possible to suppress the strain in the strip by reducing the circumferential speed of the copper roll.

Subsequently, the sample of the rapidly quenched strip is further subjected to heat treatment for 15 minutes at 700° C. in vacuum and pulverized and subjected to a nitriding treatment in a nitrogen atmosphere of 20 atm at 400° C. for 6 h to obtain the magnetic material powder as in Example 1. The resultant composition of the powder is Sm 7.5 at %, Zr 1.1 at %, Co 25.0 at %, N 7.4 at %, and the balance of Fe. A bond magnet is produced by using the powder in the same way as in Example 1.

Figure 6:
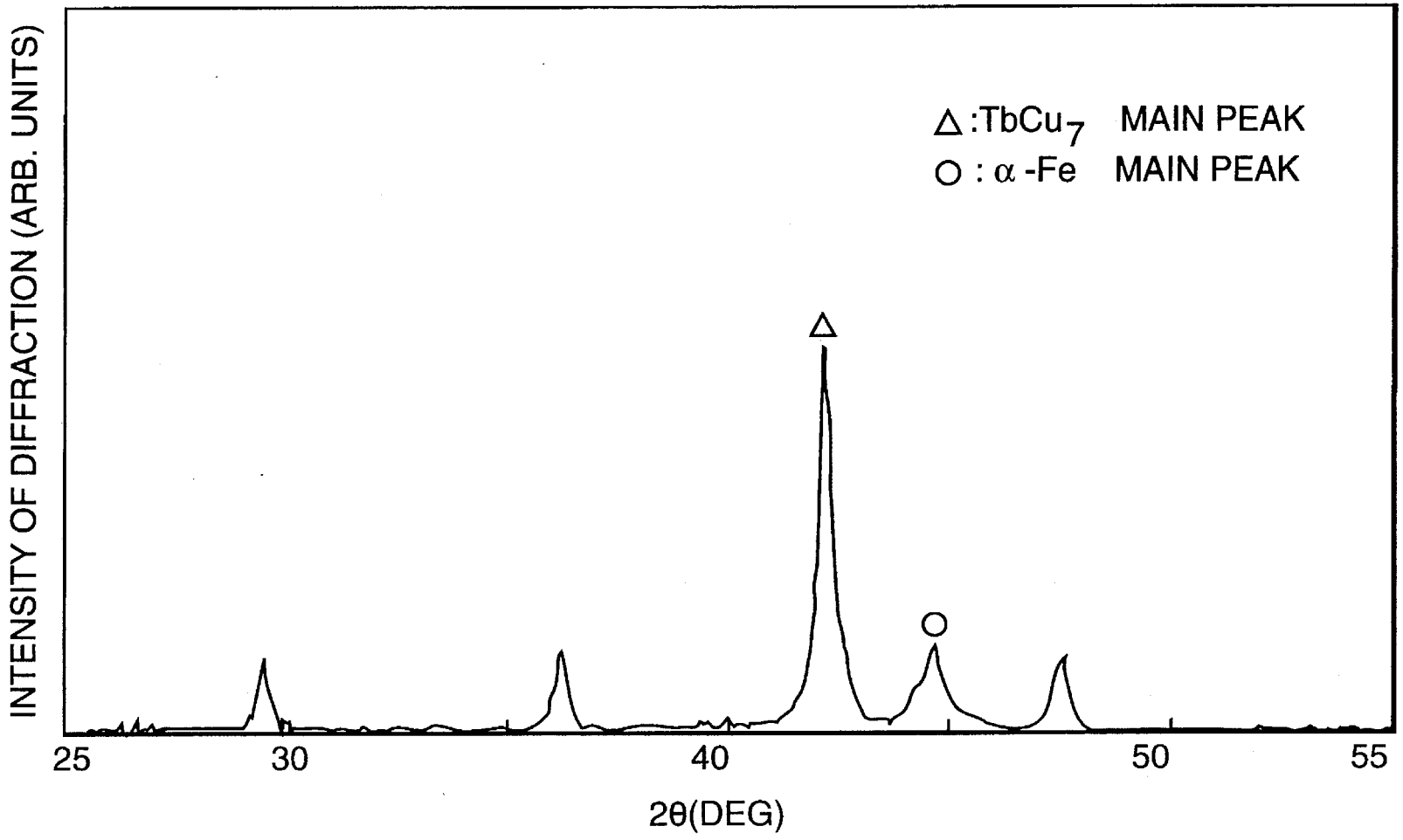
FIG. 6 is a graph showing an X-ray diffraction pattern of a magnetic material of Example 8.

The magnetic properties of the resultant bond magnet are the residual magnetic flux density of 6.3 kG and the magnetic coercive force of 9.2 kOe. The peak width is less than 0.8° as shown in FIG. 6 and the value of $I_{Fe}/(I_{Fe}+I_p)$ is less than 0.4.

EXAMPLES 9 TO 17

High purity Nd, Pr, Sm, Co, Fe, Zr, Ti, V and Mo are adjusted in a preselected manner, and nine kinds of rapidly quenched strips are produced by the same method as in Example 1. Subsequently, each sample of the strips is subjected to heat treatment for four hours at 400° C. and is further subjected to heat treatment for 15 minutes at 700° C. in vacuum and then pulverized to obtain the magnetic material powder having an average particle diameter of 20 μm. Subsequently, the powder is subjected to a nitriding treatment for four hours at 460° C. in a nitrogen gas atmosphere kept at 1 to 100 atm.

Each obtained magnetic material powder has the composition shown in Table 2 below and the total amount of T* in the principal phase is listed in Table 2. Each X-ray diffraction pattern is like that shown in FIG. 3. Each peak width is less than 0.8° and $I_{Fe}/(I_{Fe}+I_p)$ is less than 0.4.

Subsequently, the bond magnets are produced by the same method as in Example 1. The magnetic properties of each bond magnet at room temperature are shown in Table 2. After curing, the peak width is less than 0.8° and $I_{Fe}/(I_{Fe}+I_p)$ is less than 0.4.

TABLE 2

| Example No. | Composition (at %) ("bal": balance) |
|---|---|
| 9 | $Sm_{8.1}Zr_{1.3}Co_{19.2}N_{7.8}Fe_{bal}$ |
| 10 | $Sm_{7.6}Pr_{0.3}Zr_{1.0}Sc_{0.1}Co_{21.3}N_{8.3}Fe_{bal}$ |
| 11 | $Sm_{8.0}Ce_{0.4}Zr_{0.6}Co_{23.4}N_{6.1}C_{2.0}Fe_{bal}$ |
| 12 | $Sm_{8.1}Nd_{0.2}La_{0.1}Zr_{0.8}Co_{14.1}N_{9.2}P_{0.1}Fe_{bal}$ |
| 13 | $Sm_{7.4}Y_{1.0}Zr_{1.4}Co_{26.3}N_{8.1}Fe_{bal}$ |
| 14 | $Sm_{9.0}Zr_{0.6}Mo_{3.1}Co_{20.1}N_{9.0}Fe_{bal}$ |
| 15 | $Sm_{6.9}Tb_{0.1}Zr_{2.1}Hf_{0.13}V_{3.3}N_{8.9}Fe_{bal}$ |
| 16 | $Sm_{7.1}Zr_{2.6}Ti_{1.3}Co_{24.6}N_{8.8}Fe_{bal}$ |
| 17 | $Sm_{6.6}Zr_{3.7}Si_{4.1}Al_{0.1}Ga_{0.1}Co_{21.3}N_{8.6}Fe_{bal}$ |

| Example No. | T* (at %) | Br (kG) | iHc (kOe) | peak width | $I_{Fe}/(I_{Fe}+I_p)$ |
|---|---|---|---|---|---|
| 9 | 91.3 | 6.6 | 9.3 | 0.58 | 0.26 |
| 10 | 91.2 | 6.7 | 8.4 | 0.61 | 0.28 |
| 11 | 91.4 | 6.7 | 8.3 | 0.66 | 0.36 |
| 12 | 91.1 | 6.3 | 8.9 | 0.57 | 0.31 |
| 13 | 91.6 | 6.5 | 9.1 | 0.63 | 0.22 |
| 14 | 91.1 | 6.1 | 9.4 | 0.60 | 0.28 |
| 15 | 91.3 | 5.6 | 8.8 | 0.59 | 0.29 |
| 16 | 91.2 | 5.7 | 9.1 | 0.59 | 0.28 |
| 17 | 91.5 | 5.3 | 9.2 | 0.56 | 0.31 |

EXAMPLE 18 AND COMPARISON EXAMPLE 3

Twenty bond magnets are produced in the same manner as in Example 1. As a result, 18 of the 20 magnets have magnetic properties of a residual magnetic flux density of 5.0 kG or more and a magnetic coercive force of 6.0 kOe or more.

Also, 20 bond magnets are produced in the same manner as in Comparison example 1. As a result, only one magnet has the properties of 6.1 kG and 8.6 kOe, and in the other magnets have the properties of less than 5.0 kG and less than 6.0 kOe. Therefore, according to the present invention, the magnet having excellent magnetic properties can be produce with a high yield rate.

As described above, according to the present invention, it is possible to provide a hard magnetic material which has an excellent magnetic anisotropy and a high saturation magnetic flux density with an excellent thermal stability to thereby enhance a yield in production. The material can be usefully applied as a starting material of permanent magnets.

Various details of the invention may be changed without departing from the spirit nor scope. Furthermore, the foregoing description of the embodiments according to the present invention is provided for the purpose of illustration only, and not for the purpose of limiting the invention as defined by the appended claims and their equivalents.

What is claimed is:

1. A magnetic material which is represented by a formula:

$$R1_xR2_yA_zCo_uFe_{100-x-y-z-u}$$

where R1 is at least one element selected from rare earth elements, R2 is at least one element selected from the group consisting of Sc, Zr and Hf, A is at least one element selected from the group of C, N and P, x,y,z and u are atomic percent defined as $2 \leqq x$, $4 \leqq x+y \leqq 20$, $0.01 \leqq z \leqq 20$, $0 \leqq u \leqq 70$, wherein the crystal structure of a principal phase is $TbCu_7$ structure, and a peak width at half height of the main peak of X-ray diffraction of the principal phase using Cu-Kα X-rays with a resolution of 0.02° or less is about 0.8° or less.

2. A magnetic material according to claim 1, wherein the amount of Fe is the largest among the elements composing the material.

3. A magnetic material according to claim 1, wherein the amount of the principal phase is more than 50 vol % of the material.

4. A magnetic material according to claim 1, wherein an element M selected from the group consisting of Si, Ti, Cr, V, Mo, W, Mn, Ni, Ga and Al replaces a part of Fe.

5. A magnetic material according to claim 1, wherein a combined concentration of Fe and Co in the principal phase except for the element A is about 90 at % or more.

6. A magnetic material according to claim 1, wherein the value of $I_{Fe}/(I_p+I_{Fe})$ is about 0.4 or less where $I_p$ is the peak intensity of main peak of X-ray diffraction of the principal phase obtained by using Cu-Kα X-rays and $I_{Fe}$ is that of α-Fe.

7. A permanent magnet comprising a magnetic material represented by:

$R1_xR2_yA_zCo_uFe_{100-x-y-z-u}$ where R1 is at least one element selected from rare earth elements, R2 is at least one element selected from the group consisting of Sc, Zr and Hf, A is at least one element selected from the group of C, N and P, x,y,z and u are atomic percent defined as $2 \leqq x$, $4 \leqq x+y \leqq 20$, $0.01 \leqq z \leqq 20$, $0 \leqq u \leqq 70$, wherein the material comprises a principal phase of $TbCu_7$ structure and α-Fe, a peak width at half height of the main peak of X-ray diffraction of the principal phase obtained by using Cu-Kα X-rays with a resolution of 0.02 or less is about 0.8° or less, and a ratio of peak intensity between the principal phase and α-Fe satisfies a relation that the value of $I_{Fe}/(I_p+I_{Fe})$ is about 0.4 or less where $I_p$ is the peak intensity of the main peak of X-ray diffraction of the principal phase obtained by using Cu-Kα X-rays and $I_{Fe}$ is that of α-Fe.

8. A permanent magnet according to claim 7, further comprising a bonding material which bonds particles composed of said magnetic material to produce a bond magnet.

9. A permanent magnet according to claim 8, wherein said bonding material is resin.

10. A magnetic material produced by a method comprising the steps of:

melting a raw material having a ratio of components represented by:

$R1_xR2_yA_zCo_uFe_{100-x-y-z-u}$ where R1 is at least one element selected from rare earth elements, R2 is at least one element selected from the group consisting of Sc, Zr and Hf, A is at least one element selected from the group of C, N and P, x,y,z and u are atomic percent defined as $2 \leqq x$, $4 \leqq x+y \leqq 20$, $0.01 \leqq z \leqq 20$, $0 \leqq u \leqq 70$;

quenching the melted raw material to obtain a material comprising a principal phase of $TbCu_7$ crystal structure; and heat treating the quenched material at a temperature selected to provide a peak width of about 0.8° or less at half height of the main peak of X-ray diffraction of the principal phase obtained by using Cu-Kα X-rays with a resolution of 0.02° or less, and to provide a value of $I_{Fe}/(I_p+I_{Fe})$ to be about 0.4 or less where $I_p$ is the peak intensity of the main peak of X-ray diffraction of the principal phase obtained by using Cu-Kα X-rays and $I_{Fe}$ is that of α-Fe.

11. A magnetic material according to claim 10, wherein said method further comprises a nitriding step to nitride the magnetic material.

12. A magnetic material according to claim 10, wherein the selected temperature is in the range of about 300° C. to about 1000° C.

* * * * *